US010172433B2

(12) United States Patent
Kikuchi et al.

(10) Patent No.: US 10,172,433 B2
(45) Date of Patent: Jan. 8, 2019

(54) PRODUCT DISPENSER AND SECUREMENT CUP

(71) Applicant: PT. Kemas Indah Maju Co., Ltd., Jakarta (ID)

(72) Inventors: Goro Kikuchi, Chiba (JP); Nata Kumara Dinata, Jakarta Utara (ID)

(73) Assignee: PT. KEMAS INDAH MAJU CO., LTD., Jakarta Timur (ID)

( * ) Notice: Subject to any disclaimer, the term of this patent is extended or adjusted under 35 U.S.C. 154(b) by 0 days.

(21) Appl. No.: 15/563,275

(22) PCT Filed: Mar. 31, 2016

(86) PCT No.: PCT/IB2016/000477
§ 371 (c)(1),
(2) Date: Sep. 29, 2017

(87) PCT Pub. No.: WO2016/156976
PCT Pub. Date: Oct. 6, 2016

(65) Prior Publication Data

US 2018/0070703 A1 Mar. 15, 2018

Related U.S. Application Data

(60) Provisional application No. 62/139,947, filed on Mar. 30, 2015.

(51) Int. Cl.
*A45D 40/00* (2006.01)
*A45D 40/02* (2006.01)

(52) U.S. Cl.
CPC ..... *A45D 40/02* (2013.01); *A45D 2040/0006* (2013.01); *A45D 2040/0025* (2013.01); *A45D 2040/0062* (2013.01)

(58) Field of Classification Search
CPC ..... A45D 40/0062; A45D 2040/0062
(Continued)

(56) References Cited

U.S. PATENT DOCUMENTS 2,318,152 A 5/1943 Gelardin
5,560,727 A 10/1996 Vaupel
(Continued)

FOREIGN PATENT DOCUMENTS

FR 2698528 A1 6/1994
JP S63169016 U 11/1988
(Continued)

OTHER PUBLICATIONS

International Search Report and Written Opinion dated Aug. 23, 2016, for corresponding International Application No. PCT/IB2016/000477, filed Mar. 31, 2016 (8 pages).

*Primary Examiner* — David Walczak
*Assistant Examiner* — Joshua Wiljanen
(74) *Attorney, Agent, or Firm* — Daniel F. Nesbitt; Hasse & Nesbitt LLC

(57) ABSTRACT

A lipstick cup for securing a lipstick cylinder or bullet, suitable for a soft lipstick formula, having a cylindrical body with a base and a sidewall having axially-arranged ribs distributed substantially evenly around the inner circumference of the sidewall near the base, that extending radially inwardly from the sidewall, and a plurality of shallow undercut structures distributed substantially evenly around the circumference of the sidewall, disposed circumferentially between the pairs of adjacent ribs, and tapering inwardly from the inner surface of the sidewall toward the base to provide an undersurface. The plurality of ribs displace and compress a portion of the material of the lipstick composition circumferentially toward and between the undersurface of the shallow undercut structures, and the
(Continued)

base, for preventing the product from being dislodged from the cup.

17 Claims, 6 Drawing Sheets

(58) Field of Classification Search
USPC ..... 401/49
See application file for complete search history.

(56) References Cited

U.S. PATENT DOCUMENTS

| | | | | |
|---|---|---|---|---|
| 6,244,770 | B1 * | 6/2001 | Holloway | A45D 40/06 401/75 |
| 9,185,962 | B2 | 11/2015 | Holloway | |

FOREIGN PATENT DOCUMENTS

| | | | |
|---|---|---|---|
| JP | H0346643 | Y2 | 10/1991 |
| WO | 9212651 | A1 | 8/1992 |

* cited by examiner

PRODUCT DISPENSER AND SECUREMENT CUP

CROSS-REFERENCE TO RELATED APPLICATIONS

This application is a US National Stage of International Application No. PCT/IB2016/000477, filed Mar. 31, 2016, which claims benefit of U.S. Provisional Application No. 62/139,947, filed Mar. 30, 2015, the disclosures of which are incorporated herein by reference.

FIELD OF THE INVENTION

The present invention relates to a dispenser for a lipstick product.

BACKGROUND OF THE INVENTION

Products having a stick-like form for dispensing are generally in the nature of semi-solid or highly viscous materials, such as known cosmetic products which include lipstick, eye shadow, eye liner, mascara and the like. Other products which are dispensable in stick-like form are known as personal care and hygiene products, for example, deodorants, lip balms, sunscreens, insect repellents and the like. Generally, there are known other products such as household products which can be dispensed in stick-like form, for example, adhesives, polishes and the like. There is therefore known a number of products in stick-like form which are dispensable for various applications.

One form of a known dispenser for cosmetics is referred to as a lipstick case. The lipstick case generally includes a housing which is covered by a removable cap when the contained lipstick in stick-like form is in a retracted position. Upon removing the cap, the lipstick is advanced through the housing by means of a mechanism so as to expose the lipstick for application. The lipstick is typically mounted in a holder or a cup, which is engaged by the mechanism to enable the lipstick to be moved within the housing between a retracted storage position and an extended user or application position. In order for the dispenser to function properly, it is a requirement that the lipstick retained within its holder or cup during ordinary handling and use.

To this end, there is known various designs for securing a lipstick to its holder or cup. For example, Vaupel, U.S. Pat. No. 5,560,727 (the disclosure of which is incorporated by reference in its entirety) discloses a lipstick carrier having a spring element provided with an outwardly facing cam which engage a recess at the end of an outer lipstick tube to prevent the lipstick cup from slipping out of the lipstick tube. At other times when the lipstick is retracted, rear engagement lugs on the spring element embed into the lipstick upon engagement of the cam with the inner surface of the lipstick tube to prevent the lipstick from slipping out of the lipstick carrier. However, the securing action is eliminated when the lipstick is fully extending, which can cause the lipstick to accidentally dislodge from the lipstick carrier during use.

Hopgood, U.S. Pat. No. 2,797,803 and Wild, U.S. Pat. No. 1,835,580 (the disclosure of which are incorporated by reference in their entirety) discloses a rigid metal carrier of open cylindrical cup shape. A pair of inwardly directed lugs formed from a portion of the metallic carrier is operative for retaining the inserted stick cosmetic, for example, stick colognes, stick deodorants and the like.

Reichenbach, U.S. Pat. No. 2,302,473 (the disclosure of which is incorporated by reference in its entirety) discloses a lipstick carrier having a metallic cup-shaped carrier formed with an annular inwardly projecting rib to aid in retaining the lipstick within the carrier.

Mazzola, et al., U.S. Pat. No. 5,609,430; Ackermann, et al., U.S. Pat. No. 5,599,124; Lombardi, et al., U.S. Pat. No. 5,197,814; Clark, U.S. Pat. No. 3,083,822; Grau, U.S. Pat. No. 3,838,169; Hultgren, U.S. Pat. No. 3,298,509; Spatz, U.S. Pat. No. 4,820,070 and German Patent No. DE 3442094 (the disclosure of which are incorporated by reference in their entirety) disclose a lipstick carrier provided with a plurality of inwardly directed longitudinally extending ribs for engaging the lipstick and securing same within the carrier.

Croce, U.S. Pat. No. 2,798,599 (the disclosure of which is incorporated by reference in its entirety) discloses a lipstick carrier having a pair of spaced apart helical ribs projecting inwardly for engaging the lipstick. When a lipstick is inserted into the carrier, the lipstick is cammed by the internal ribs so as to turn itself during the insertion operation thereby anchoring the lipstick in the carrier.

Gelardin, U.S. Pat. No. 2,318,152 (the disclosure of which is incorporated by reference in its entirety) discloses a lipstick carrier provided with a pair of inwardly directed tongues formed as dihedral angles with a sharp outer edge. The outer edges of the tongues are notched for anchoring a lipstick within the carrier against displacement therefrom.

Broder, U.S. Pat. No. 2,469,631 (the disclosure of which is incorporated by reference in its entirety) discloses a lipstick carrier having a base plate from which there extends a plurality of triangular-shaped prongs into which the lipstick is pressed.

Safianoff, U.S. Pat. No. 2,815,123 (the disclosure of which is incorporated by reference in its entirety) discloses a lipstick carrier which includes an internal ring supported by a plurality of radially extending ribs into which the bottom of a lipstick is embedded.

Patel et al, U.S. Pat. No. 6,116,801 (the disclosure of which is incorporated by reference in its entirety) discloses a lipstick holder including a plurality of barbs extending from the holder or cup, formed of resilient polymer material having spring-like properties while being resiliently flexible. The barbs, due to their spring-like properties, reorient themselves away from the interior surface of the holder or cup to embed themselves into the lipstick bullet after insertion. Vibration that might tend to cause the product to move axially within the holder or cup, causes the barbs to penetrate further into the product further securing the product from movement. A person of ordinary skill in the art of injection molding of thermoplastic parts, such as the lipstick holder of Patel et al, would recognize the complexity and difficulty of molding the resilient barbs extending well into the interior of the cup.

Notwithstanding the foregoing, there has been recognized a continuous problem of the lipstick or other product to be dispensed in stick-like form being dislodged from its holder or carrier. This can occur when the dispenser is subject to vibration, shock or repeated movement, such as during shipment, dropping of the lipstick case and jostling within the purse or baggage by the user. Under these conditions, it is possible for the base of the lipstick bullet to become dislodged from the cup, and for the formed tip of the lipstick to compress into the inner surface of the cup so as to be deformed. This results in a product which is not acceptable to the consumer, thereby often prompting return of the dispenser by either the distributor or consumer.

A common lipstick holder or cup includes a plurality of spaced apart ribs disposed on the inner surface of the sidewall of the cup which, during the insertion process, exert a resistance pressure by cutting through the outer surface material of the lipstick bullet. Generally, the radially-inward profile of the ribs should be minimized to not produce a distortion in shape or damage in the structural integrity of the molded lipstick bullet. The lipstick package designer is confronted with achieving the goal of maximum retention by using wide and long ribs that extend into the bullet profile, without displacing an excessive volume of the bullet material which can weaken the mechanical strength of the lipstick bullet itself, and can produce internal cracks that can destroy the structural integrity of the bullet.

These aforementioned challenges are even more amplified when the lipstick is a softer lipstick formula.

Accordingly, there is still the room for improvements in dispensers for various products which are provided in stick-like form in the nature of a semi-solid or highly viscous material for a multitude of applications.

SUMMARY OF THE INVENTION

The present invention provides an product dispenser for semi-solid or viscous materials, such as lipstick and other cosmetic products, personal care and hygiene products, household products and the like which are provided generally in stick-like form. The product dispenser has a holder or cup for securely retaining a base of a stick-like composition form within the holder or cup of the dispenser subsequent to manufacture, for example, during shipment, storage and subsequent handling and use by the consumer. The product dispenser includes a plurality of shallow undercut structures extending radially inward from and circumferentially along the inner surface of sidewall of the cup to ensure that the product to be dispensed remains secure within the holder or cup at all times. The shallow undercut structures are typically formed integrally with the wall of the cup. The undercut structures have an inwardly-facing surface that extend inwardly from the cup wall, tapering from the cup wall at an upper end to a lower extended ledge. The undercut structure also includes an undersurface that extends radially outwardly from the lower extended ledge to the inner surface of the sidewall. The undersurface faces downward toward the base of the cup, and is horizontal or along a slight angle, typically less than 30 degrees, downward form horizontal.

The present invention further provides an injection-molded lipstick cup for a cylinder of lipstick, used in a lipstick case, the cup comprising: a cylindrical body including a base and a sidewall having an inner surface defining an interior opening adapted for receiving a base portion of the lipstick, a plurality of axially-arranged ribs distributed substantially evenly around the circumference of the sidewall and proximate the base, extending radially inwardly from the inner surface of the sidewall, and a plurality of shallow undercut structures distributed substantially evenly around the circumference of the sidewall, disposed circumferentially between adjacent ribs, the shallow undercut structures including an inwardly-facing surface facing radially inwardly and tapering down and away from the inner surface of the sidewall, and toward the base, to a lower extended ledge, and an undersurface that extends radially outwardly from lower extended ledge to the inner surface of the sidewall, that faces toward the base.

In an aspect of the invention, the inwardly-facing surface of the undercut structure is a concave surface.

In another aspect of the invention, the inward-facing surface of the undercut structure has a lateral curvature that follows the curvature of the inside surface of the sidewall, and can have a thickness that is substantially the same from one side laterally to the opposite side.

In another aspect of the invention, the undercut structure has an increasing thickness, from a top end toward the lower extended ledge.

In another aspect of the invention, the inward-facing surface of the undercut structure, is about 30 degrees or less, including about 20 degrees or less, and about 15 degrees or less, from the inner surface of the sidewall.

In another aspect of the present invention, the holder or cup is made by an injection molding process and equipment.

The cup can be formed of a thermoplastic material using an injection molding process.

It has been found that the shallow undercut structures provided in the cup improve the retention of the lipstick cylinder from moving upward axially within of the cup and away from the base, as may be caused by vibration. Without being bound by any particular theory, it is believed that the undersurface of the shallow undercut structures establish a wall to block material of the lipstick bullet that has accumulated and compacted underneath the shallow undercut structures. Accumulation of the lipstick material can result from the use of a plurality of spaced-apart axially-aligned ribs that are distributed substantially evenly around the circumference of the sidewall proximate the base and that extend radially inwardly from the inner surface of the sidewall, which compress a portion of the surface material of the base portion of the lipstick cylinder circumferentially toward and between the undersurface of the shallow undercut structures, and the base. The compressing and movement of the portion of the surface material below the undersurface of the shallow undercut structures limits and prevents the lipstick cylinder from being dislodged from the cup.

The present invention also provides a method for securing a lipstick cylinder within a cup, including the steps of: a) providing a cup according the present invention, having a plurality of undercut structures as described, b) inserting axially a lipstick cylinder comprising a semi-solid or waxy material into the cup, so that a bottom end of the lipstick cylinder extends over and below the undercut structures, to the base of the cup, whereby the lipstick cylinder is securely retained within the cup, wherein the undercut structures resist axial movement of the lipstick cylinder away from the base, and prevent the lipstick cylinder from being dislodged from the cup.

BRIEF DESCRIPTION OF THE DRAWINGS

The above description, as well as further objects, features and advantages of the present invention will be more fully understood with reference to the following detailed description of a product dispenser and holder, when taken in conjunction with the accompanying drawings, wherein.

DETAILED DESCRIPTION OF THE INVENTION

Figure 1:
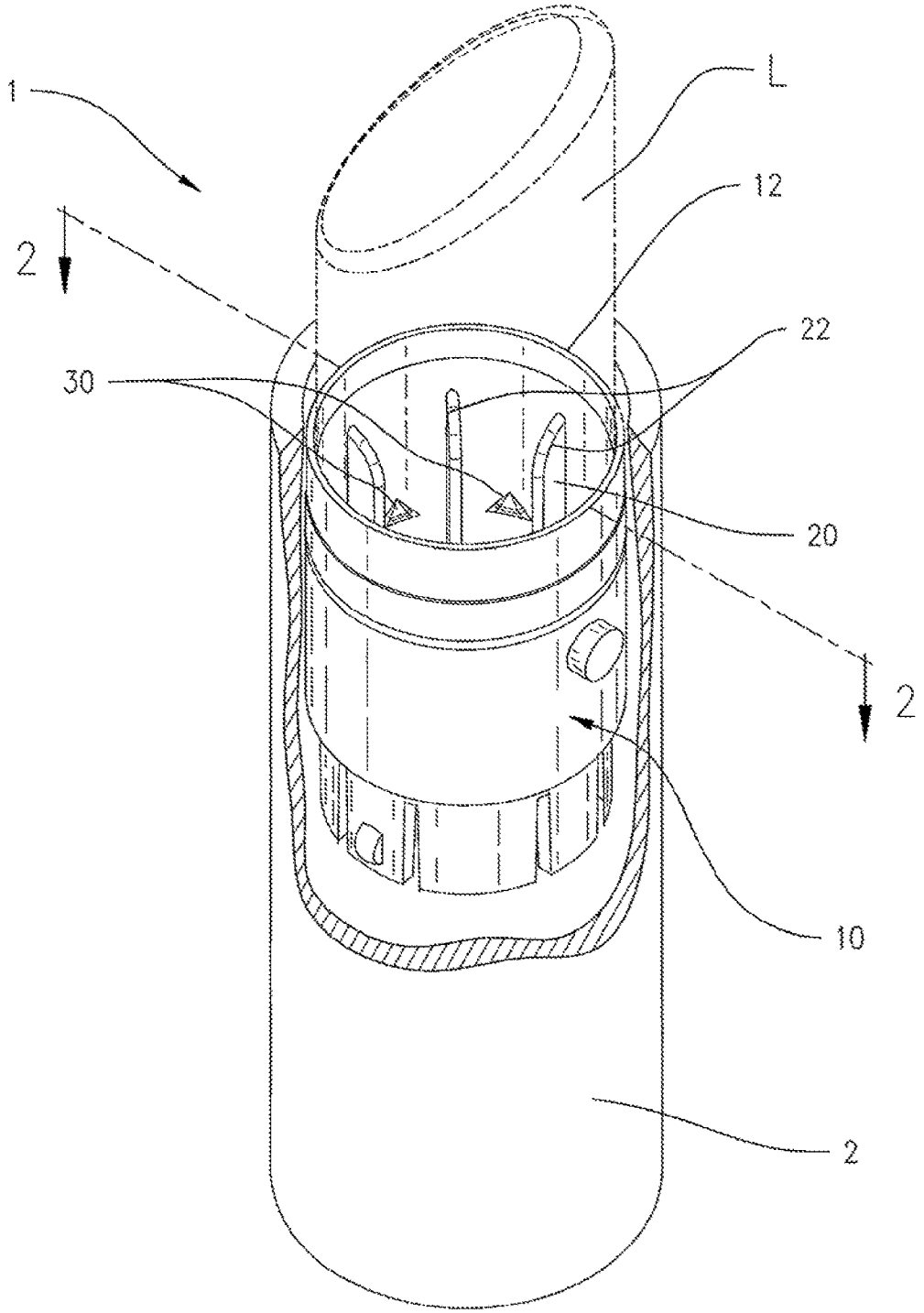
FIG. 1 shows a perspective, cut-away view of a lipstick product dispenser to show a lipstick cup having a plurality of undercut structures disposed on the inner surface of its sidewalls, for holding a lipstick cylinder.
Figure 2:
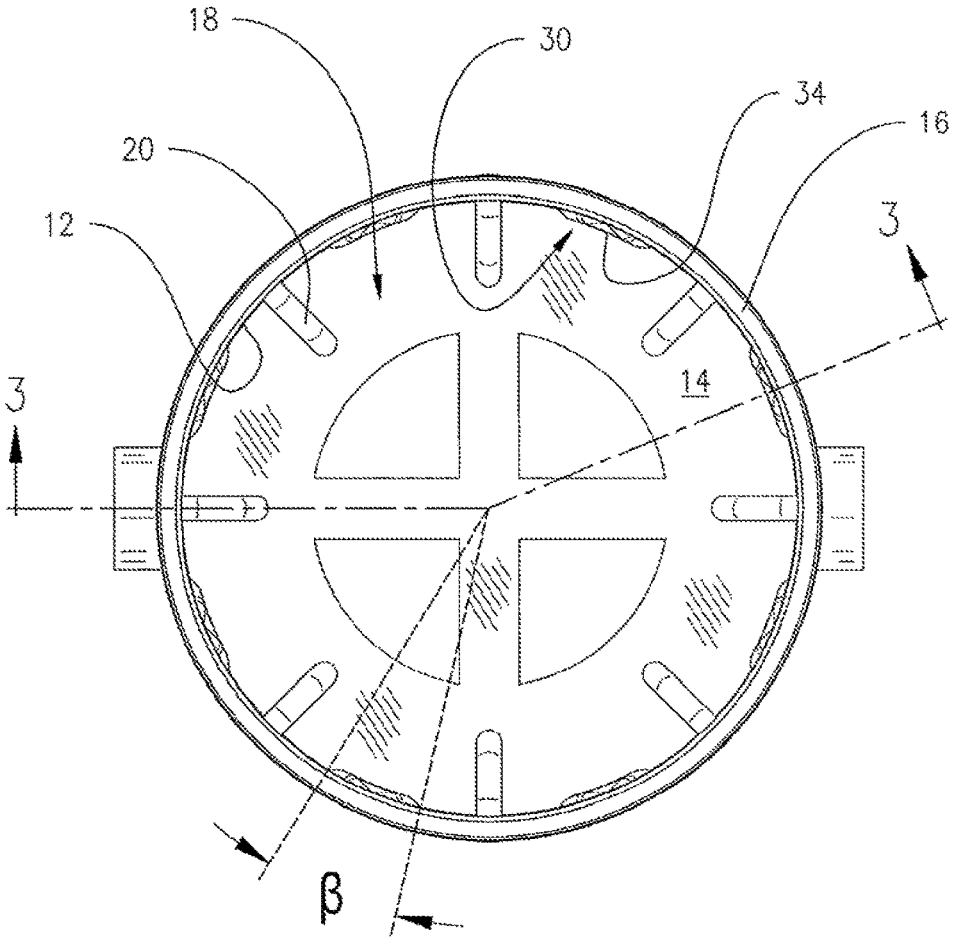
FIG. 2 shows a top plan view the lipstick cup, viewed along line 2-2 of FIG. 1.
Figure 3:
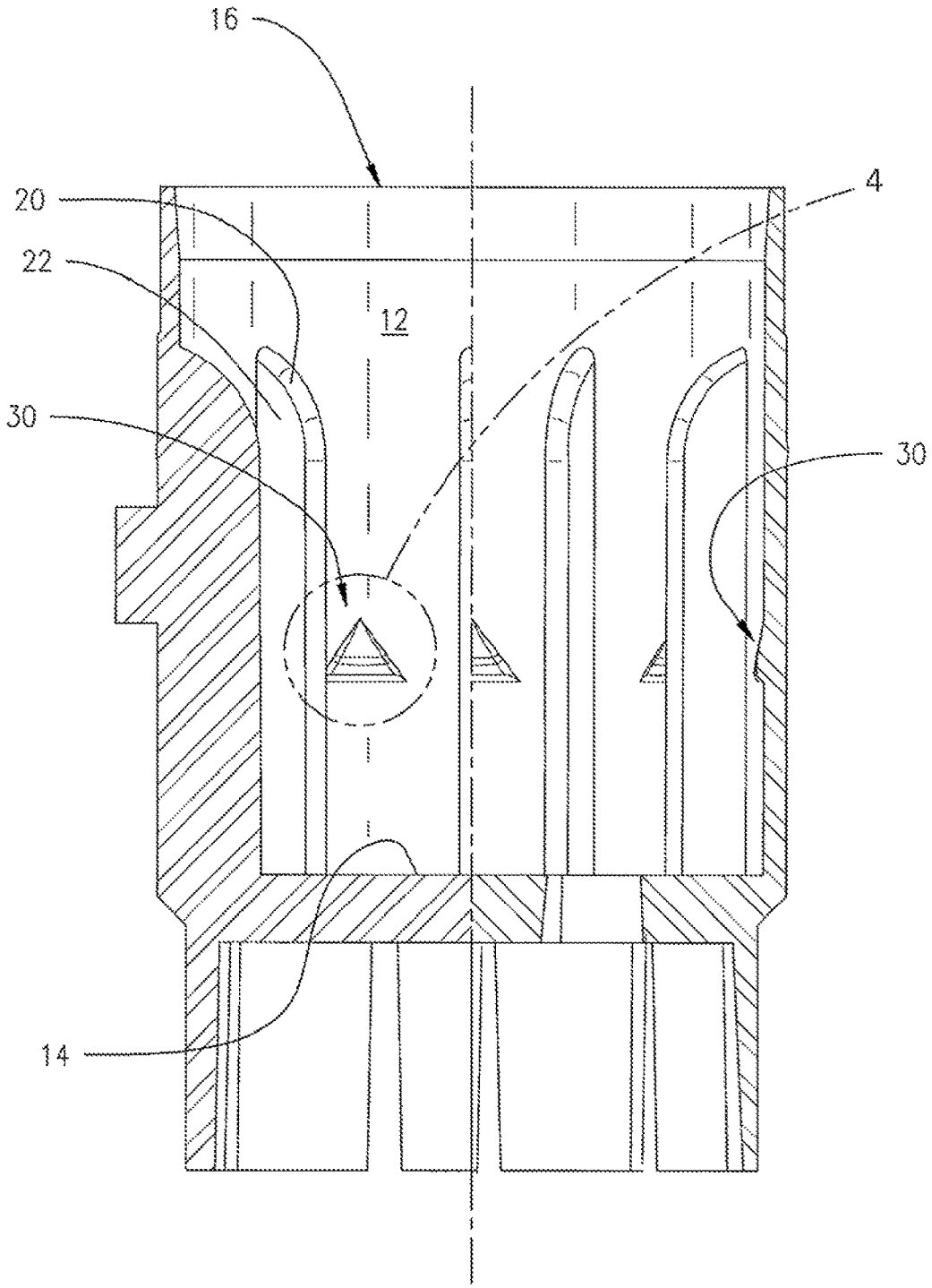
FIG. 3 shows a sectional view of the lipstick cup, viewed along line 3-3 of FIG. 2.

Referring to the drawings, wherein like reference numerals represent like elements, there is shown in FIGS. 1 through 3, a lipstick dispenser 1 having an outer body 2 and a holder or cup 10 for securing the base end of a lipstick cylinder L (shown in silhouette to not obscure the details of the cup). The cup 10 includes an annular sidewall 12 that defines a top opening 16, and a base 14 that cooperates with the sidewall 12 to define an inner cylindrical space 18 for holding the base end of a lipstick cylinder L. The cup 10 also has eight equally-spaced, axially-aligned ribs 20 that are distributed substantially evenly around the circumference of the inner surface of the annular sidewall 12, proximate the base 14. The ribs 20 extend a distance radially inwardly from the annular sidewall 12, toward the centerline 100 of the cup 10, and the inner edge of each rib 20 is rounded. The upper end 22 of the ribs 20 extend upward toward the top opening 16, and curves toward the sidewall 12. The ribs 20 press into the bottom and the outer peripheral surface of the lipstick cylinder L as the lipstick cylinder is inserted axially into the inner cylindrical space 18 to the base 14, to aid retention of the lipstick cylinder L within and prevent its axial rotation relative to the cup 10.

The cup 10 also includes eight shallow undercut structures 30 extending from the inner surface of the sidewall 12, and spaced equally between adjacent ribs 20. The undercut structures 30 are positioned a distance axially from the base 14, at a height position intermediate the height of upper end 22 of the ribs 20. In the illustrated embodiment, the shallow undercut structures 30 are positioned about half-way up the height of the sidewall, although a lightly lower or higher height can be used. The inward-facing surface 32 of the shallow undercut structures 30 face radially inwardly and taper from an upper edge 31, down and away from the sidewall 12 to a lower extended ledge 34.

Figure 5:
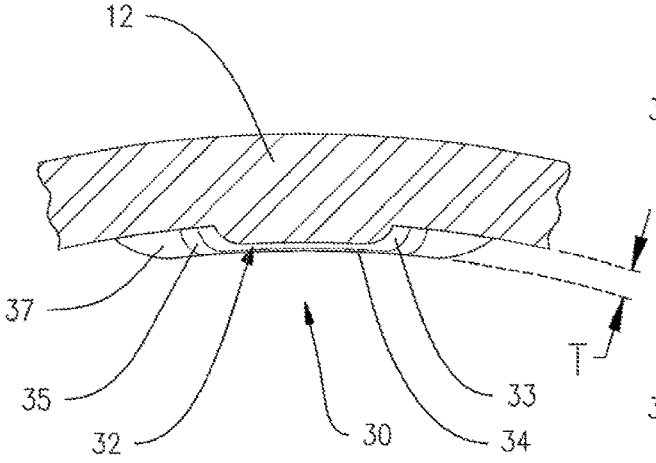
FIG. 5 shows a horizontal sectional view of the undercut structure of FIG. 4, viewed along line 5-5.
Figure 6:
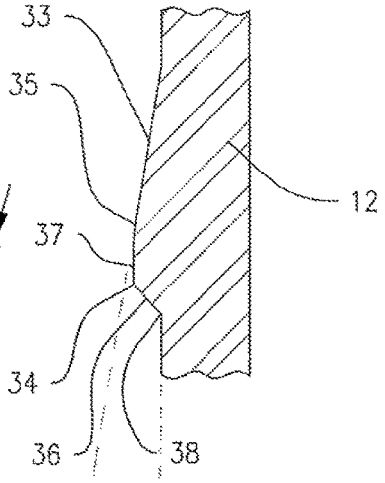
FIG. 6 shows a vertical sectional view of the undercut structure of FIG. 4, viewed along line 6-6.
Figure 4:
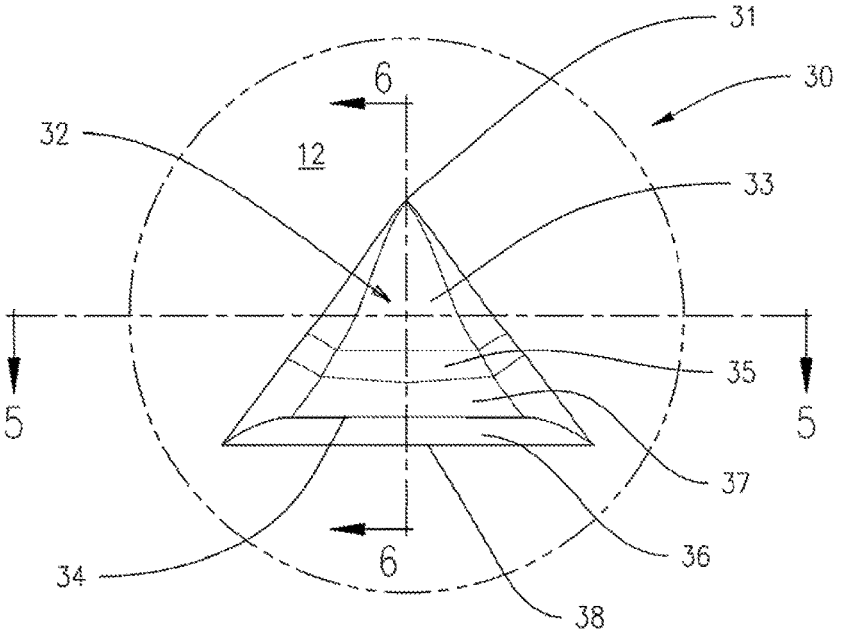
FIG. 4 shows detailed view of the undercut structure of FIG. 3.

An embodiment of the undercut structure is shown in FIGS. 4 through 6, and has a generally pyramidal shape. The inwardly-facing surface 32 of the undercut structure 30 is substantially concave, as illustrated in FIG. 5. The inward-facing surface 32 of the undercut structure 30 has a lateral curvature that follows the curvature of the inside surface of the sidewall 12, and the thickness of the undercut structure 30 laterally, from side to side, is substantially the same. The inward-facing surface 32 of the undercut structure 30 tapers inwardly, and the undercut structure 30 has increasing thickness, from the top end 31, toward a lower extended ledge 34. Typically, the inward taper of the surface 32, from vertical or the inner surface of the sidewall 12, is about 30 degrees or less, including about 20 degrees or less, and about 15 degrees or less The lower extended ledge 34 extends radially inwardly by a substantially equal distance from the sidewall 12 along its circumferential length. As shown in FIG. 5, the curved, lower extended ledge 34 has a lateral curvature that follows the curvature of the inside surface of the sidewall 12, and has substantially the same distance radially from the inside surface of the sidewall 12, shown as distance T.

The inward-facing surface 32 of the undercut structure 30 includes an upper portion 33 that tapers downwardly from the upper edge 31 (shown as a point) and intersects with an intermediate portion 35, which then intersects with a bottom portion 37 that extends to the lower extended ledge 34. The tapering of the inward-facing surface 32 prevents tearing of the base structure of the lipstick cylinder L as the material of the lipstick cylinder L slides down the inward-facing surface 32, and over and past the undercut structure 30.

An undersurface 36 extends from the lower extended ledge 34 back, or radially outwardly, to the inner surface of the sidewall 12 along line 38, below the undercut structure 30. The undersurface 36 faces downward toward the base 14, and is typically angled from horizontal sufficiently to provide a functional benefit of the securement or retention of the lipstick cylinder within the cup 10, described below.

The angular displacement β(FIG. 2) of an undersurface 36 along the circumference of the sidewall 12, is typically about 15-30 degrees, and more typically about 20-25 degrees.

Without being bound by any theory, the pressing of the lipstick cylinder L into the inner cylindrical space 18 forces the ribs 20 into the outer circumference of the lipstick L, which displaces the semi-solid waxy lipstick material into the space between the ribs 20. It is believed that the slight tapering and shallow lower extended ledge 34 compresses slightly and gently the semi-solid, waxy material of the lipstick cylinder L that passes along the inwardly-facing surface 32. After the waxy material of the lipstick cylinder LA passes below the curved, lower extended ledge 34, it then expands radially outwardly along and/or under the undersurface 36 toward the inner surface of the sidewall 12, without substantially deterioration of the structure of the lipstick. The plurality of undersurfaces 36 then present barrier walls that confront the lipstick material, that has expanded below the undersurface 36, to resist axial movement of the lipstick cylinder L away from the base 14, and prevent the lipstick cylinder from being dislodged from the cup 10. The undersurfaces of the present invention permit the lipstick cylinder to pass over and below its extending structure, without breaking, fracturing, or cracking the outer surface of the lipstick cylinder, particularly with soft lipstick formulations.

Figure 8:
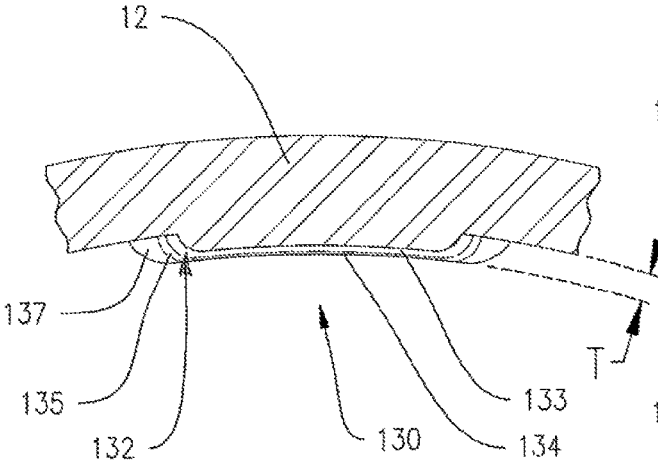
FIG. 8 shows a horizontal sectional view of the undercut structure of FIG. 7, viewed along line 8-8.
Figure 9:
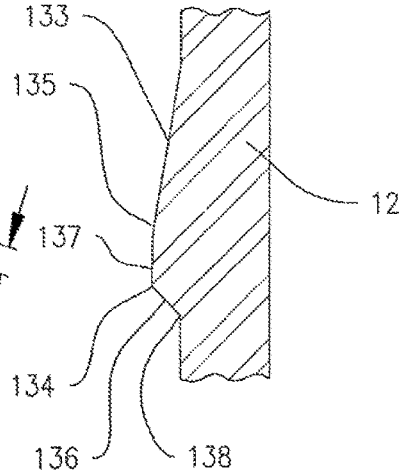
FIG. 9 shows a vertical sectional view of the undercut structure of FIG. 7, viewed along line 9-9.
Figure 7:
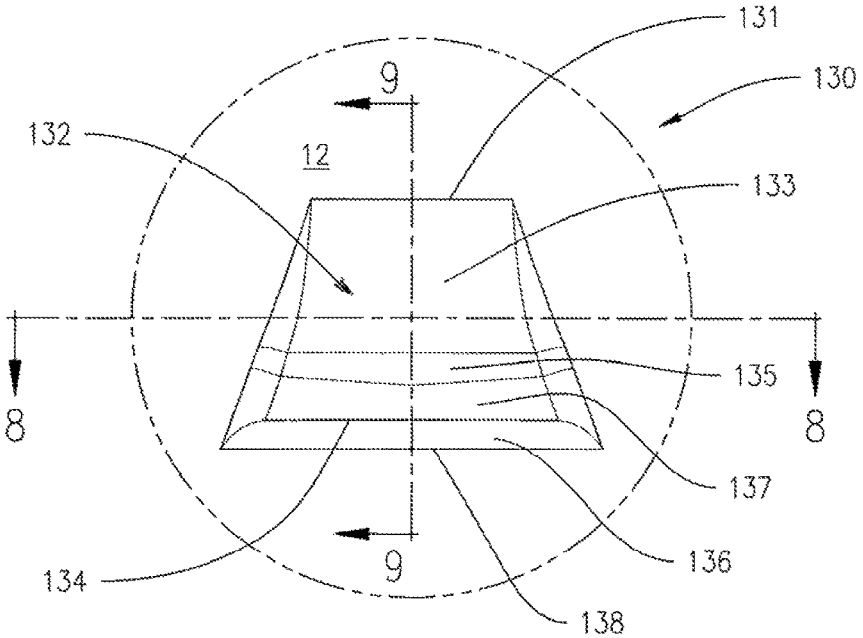
FIG. 7 shows another embodiment of an undercut structure having a frustum profile.

A further embodiment of an undercut structure is shown in FIGS. 7 through 9, as an undercut structure 130 having a frustum-shaped vertical profile, with an inwardly-facing surface 132. The inwardly-facing surface 132 can include an upper portion 133 that tapers from along the upped edge 131, and down and away the sidewall surface 12, to intersect an optional intermediate portion 135, which intersects a bottom portion 137 that has a lower extended ledge 134. An undersurface 136 extends radially outwardly from the curved lower extended ledge 134 to join the wall surface along line 138, similar to the undersurface 36 described above.

Figure 11:
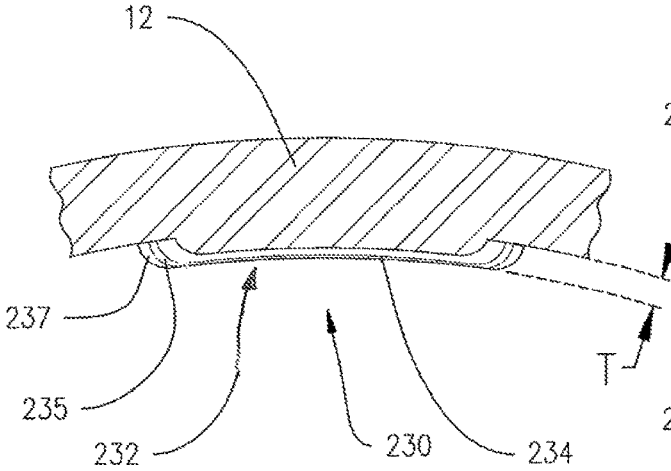
FIG. 11 shows a horizontal sectional view of the undercut structure of FIG. 10, viewed along line 11-11.
Figure 12:
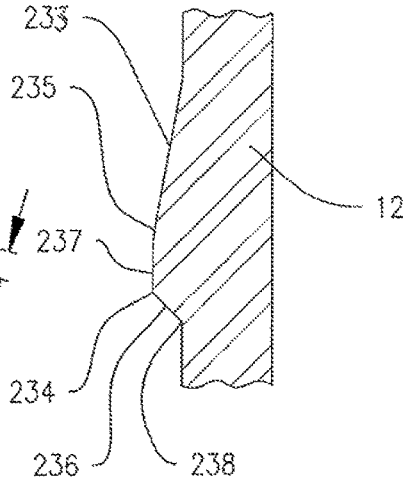
FIG. 12 shows a vertical sectional view of the undercut structure of FIG. 10, viewed along line 12-12.
Figure 10:
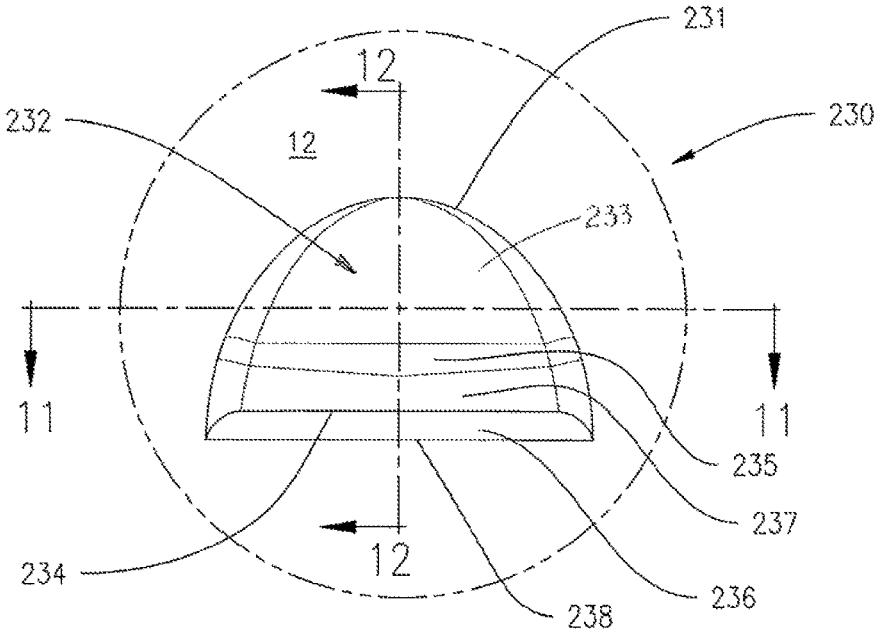
FIG. 10 shows another embodiment of the undercut structures with a curved profile.

A further embodiment of an undercut structure is shown in FIGS. 10 through 12, an undercut structure 230 having an upper curved shape or vertical profile, with an inwardly-facing surface 232. The inwardly-facing surface 232 can include an upper portion 233 that tapers downwardly from a curved top edge 231, to intersect an optional intermediate portion 235, which intersects a bottom portion 237 that has a lower extended ledge 234. An undersurface 236 extends radially outwardly from the curved lower extended ledge 234 to join the wall surface along line 238, similar to the undersurface 36 described above.

The cup 10 can be conveniently formed of a thermoplastic material using an injection molding process. The shallow undercut structures 30 have sufficient radial thickness to resist upward, axial movement of the lipstick cylinder, yet are sufficiently thin to permit the undercut to clear the mold following injection molding. The dimensions and geometry presents a very slight undercut (termed a "mini undercut") which permits the molded part to be force ejected when using a normal, non-undercut cup injection mold, eliminating the expense and complexity of molding a typical undercut-style design which requires a special, more difficult mold structure with core protrusion coming from both the core side and the cavity side of the mold.

While the illustrated embodiment shows eight equally spaced ribs 20 with eight equally spaced undercut structures 30, the number of ribs and undercut structures, respectively, can include 6-10, and either a larger number of ribs and undercut structures, such as 9-12, can be provided, or a smaller number such as 4-7, as is suitable for a particular lipstick composition.

The invention also includes a lipstick dispenser for a cylinder of lipstick, the lipstick dispenser comprising a housing, the cylinder of lipstick within the housing moveable between a storage position and a user position, and a lipstick cup for receiving the cylinder of lipstick as described herein. The lipstick dispenser can also include a cap enclosing one end of said housing when said product is in the storage position.

Although the invention herein has been described with reference to particular embodiments, it is to be understood that the embodiments are merely illustrative of the principles and application of the present invention. It is therefore to be understood that numerous modifications may be made to the embodiments and that other arrangements may be devised without departing from the spirit and scope of the present invention as defined by the claims.

We claim:

1. An injection-molded lipstick cup for a cylinder of lipstick, used in a lipstick case, the cup comprising:

i) a cylindrical body including a base and a sidewall having an inner surface defining an interior opening adapted for receiving a base portion of the lipstick, ii) a plurality of axially-arranged ribs distributed substantially evenly around the circumference of the sidewall and proximate the base, extending radially inwardly from the inner surface of the sidewall, and iii) a plurality of shallow undercut structures distributed substantially evenly around the circumference of the sidewall, disposed circumferentially between adjacent ribs, the shallow undercut structures having a surface facing radially inwardly and tapering down and away from the inner surface of the sidewall, toward the base, and to a lower extended ledge, and an undersurface that extends radially outwardly from the lower extended ledge to the inner surface of the sidewall, that faces toward the base.

2. The injection-molded lipstick cup according to claim 1 where the lower extended ledge has a lateral curvature that is substantially the same as the curvature of the inside surface of the sidewall.

3. The lipstick cup according to claim 1 wherein the plurality of ribs displace and compress a portion of the material of the base portion of the lipstick circumferentially toward and between the undersurface of the shallow undercut structures and the base, to prevent the lipstick from being dislodged from the cup.

4. The lipstick cup according to claim 1 wherein the inwardly-facing surface of the undercut structure is a concave surface.

5. The lipstick cup according to claim 4 wherein the inward-facing surface of the undercut structure has a lateral curvature that follows the curvature of the inside surface of the sidewall, and a thickness that is substantially the same from one side laterally to the opposite side.

6. The lipstick cup according to claim 5 wherein the undercut structure has an increasing thickness, from a top end toward the lower extended ledge.

7. The lipstick cup according to claim 1 wherein the inward-facing surface of the undercut structure is about 30 degrees or less, from the inner surface of the sidewall.

8. The lipstick cup according to claim 7 wherein the inward-facing surface of the undercut structure is about 20 degrees or less, from the inner surface of the sidewall.

9. The lipstick cup according to claim 8 wherein the inward-facing surface of the undercut structure is about 15 degrees or less, from the inner surface of the sidewall.

10. The lipstick cup according to claim 1 wherein the holder is made by an injection molding process and equipment.

11. The lipstick cup according to claim 10 wherein the cup can be formed of a thermoplastic material using an injection molding process.

12. The lipstick cup according to claim 1 wherein the shallow undercut structure has a generally pyramidal shape.

13. The lipstick cup according to claim 1 wherein the shallow undercut structure has a frustum shape.

14. The lipstick cup according to claim 1 wherein the shallow undercut structure has upper curved shape.

15. The lipstick cup according to claim 1 wherein the shallow undercut structures are fixed to the inner surface of the sidewall, and are integral with the sidewall.

16. A lipstick dispenser for a cylinder of lipstick, the lipstick dispenser comprising a housing, a cylinder of lipstick within the housing moveable between a storage position and a user position, and a lipstick cup according to claim 1 disposed within the housing, for receiving the cylinder of lipstick.

17. An injection-molded lipstick cup for a cylinder of lipstick, used in a lipstick case, the cup comprising:

i) a cylindrical body including a base and a sidewall having an inner surface defining an interior opening adapted for receiving a base portion of the lipstick, ii) a plurality of axially-arranged ribs distributed substantially evenly around the circumference of the sidewall and proximate the base, extending radially inwardly from the inner surface of the sidewall, and iii) a plurality of shallow undercut structures distributed substantially evenly around the circumference of the sidewall, disposed circumferentially between adjacent ribs, the shallow undercut structures each having a surface facing radially inwardly and tapering down and away from the inner surface of the sidewall, toward the base, and to a lower extended ledge having a lateral curvature that follows the curvature of the inside surface of the sidewall, and where the lower extended ledge has substantially the same distance radially from the inside surface of the sidewall, and an undersurface that extends radially outwardly from the lower extended ledge to the inner surface of the sidewall, and that faces toward the base.

* * * * *